US010363739B2

(12) United States Patent
Mukaiyama

(10) Patent No.: US 10,363,739 B2
(45) Date of Patent: Jul. 30, 2019

(54) RECORDING DEVICE AND RECORDING HEAD VOLTAGE SETTING METHOD

(71) Applicant: Konica Minolta, Inc., Chiyoda-ku, Tokyo (JP)

(72) Inventor: Takashi Mukaiyama, Hachioji (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 15/984,650

(22) Filed: May 21, 2018

(65) Prior Publication Data

US 2018/0361740 A1 Dec. 20, 2018

(30) Foreign Application Priority Data

Jun. 15, 2017 (JP) ..... 2017-117525

(51) Int. Cl.
*B41J 2/14* (2006.01)
*B41J 2/045* (2006.01)

(52) U.S. Cl.
CPC ..... *B41J 2/14* (2013.01); *B41J 2/04548* (2013.01); *B41J 2/04586* (2013.01); *B41J 2/04588* (2013.01)

(58) Field of Classification Search
CPC ..... B41J 2/14; B41J 2/04548; B41J 2/04586; B41J 2/04588
See application file for complete search history.

(56) References Cited

U.S. PATENT DOCUMENTS 5,631,675 A * 5/1997 Futagawa ..... B41J 2/04541 347/10
5,982,160 A * 11/1999 Walters ..... H02M 3/156 323/222
8,179,114 B2 * 5/2012 Hirahara ..... H02M 3/157 323/225
9,099,918 B2 * 8/2015 Sato ..... B41J 2/04541
2007/0216714 A1 * 9/2007 Sato ..... B41J 2/0458 347/5
2012/0050354 A1 * 3/2012 Taguchi ..... H02M 3/158 347/1

FOREIGN PATENT DOCUMENTS

JP 2014007903 A * 1/2014
JP 2016-107446 6/2016

OTHER PUBLICATIONS

IP.com search (Year: 2019).*

* cited by examiner

*Primary Examiner* — Lisa Solomon
(74) *Attorney, Agent, or Firm* — BakerHostetler

(57) ABSTRACT

A recording device includes: a head voltage control unit of setting target voltage of head voltage used to perform the recording operation by driving a recording head; a DC voltage generating unit generating drive voltage while giving a feedback so as to obtain a target voltage; and a smoothing capacitor connected between an output unit of the DC voltage generating unit and the recording head and having capacity which is twice or more as large as capacity of all of nozzles of the recording head driven at the same timing. The output voltage of the DC voltage generating unit is increased to the target voltage over predetermined time.

6 Claims, 7 Drawing Sheets

RECORDING DEVICE AND RECORDING HEAD VOLTAGE SETTING METHOD

CROSS-REFERENCE TO RELATED APPLICATIONS

The entire disclosure of Japanese Patent Application No. 2017-117525, filed on Jun. 15, 2017, is incorporated herein by reference in its entirety.

TECHNOLOGICAL FIELD

The present invention relates to a recording device and a recording head voltage setting method and, more particularly, relates to a technique preferably applied to a recording device having an ink jet recording head as a recording head.

BACKGROUND

In an ink jet recording head, voltage having drive waveform which is applied to the head has to be set properly to make the discharge speed or discharge amount of ink drops discharged from nozzles of the head constant. Concretely, the voltage having the drive waveform has to be properly set according to individual difference of heads, ink viscosity, temperature, and the like.

As a power supply circuit setting the voltage having the drive waveform which is applied to a head, for example, a DC-DC converter converting DC voltage to DC voltage having another voltage value is used.

In the case of supplying power from the DC-DC converter to an ink jet recording head, a capacitor having relatively large capacity is connected between the DC-DC converter and the head. The capacitor is provided to address the load fluctuation. Particularly, in recent years, there is tendency that the number of nozzles of a head is increasing and the capacity of a capacitor which is connected has to be increased in proportion to the increase in the number of nozzles.

Patent Literature 1 discloses a technique of supplying drive voltage for performing recording operation by driving an ink jet recording head via a DC-DC converter to the head. FIG. 3 of Patent Literature 1 illustrates the configuration that a smoothing capacitor for preventing load fluctuation is connected to a recording head.

CITATION LIST

Patent Literature

Patent Literature 1: Japanese Unexamined Patent Application Publication No. 2016-107446

SUMMARY

Problems to be Solved by the Invention

In the technique described in Patent Literature 1, by connecting a capacitor having large capacity between a DC-DC converter supplying drive voltage and a recording head, load fluctuation can be addressed. Specifically, depending on the number of nozzles from which ink is discharged in a number of nozzles prepared, the load current of the DC-DC converter largely fluctuates. Consequently, by connecting a capacitor of large capacity between a DC-DC converter and a recording head as described above, the load fluctuation is absorbed by the capacitor and the influence exerting on the operation of the recording head can be prevented.

As the drive voltage of a recording head, in a state where the power of a printer is turned on, high voltage which can drive the recording head is not always maintained specifically, in a period in which the recording head is not driven, that is, in a hibernation period in which it is unnecessary to discharge ink from the recording head, the voltage value of the head drive voltage is set to be low. By setting the voltage value of the head drive voltage in the hibernation period to be low as described above, the consumption voltage of the printer can be decreased, and excessive load on the recording head can be reduced.

At the time of shifting the hibernation period to the head operation period, the voltage supplied from the DC-DC converter to the recording head has to be changed to a drivable high voltage. When the output voltage of the DC-DC converter rises from the low state to the high state, there is a case that inrush current for charging the capacitor is generated and a component element in the DC-DC converter is destroyed by the inrush current. Particularly, as the capacity of the capacitor connected between the DC-DC converter and the recording head increases, the inrush current at the time of voltage rise also increases, and the possibility that the DC-DC converter is destroyed is high.

Concretely, when the capacity of the capacitor connected between the DC-DC converter and the recording head is set as C and the voltage at the time of rise is set to V, the charge amount of $CV^2/2$ is newly accumulated in the capacitor. The current value I for accumulating the charge amount of $CV^2/2$ within time "t" is expressed as $I=k\times CV^2/2t$. k denotes proportional constant related to the circuit impedance. It is understood from the equation that the larger the capacity C of the capacitor and the shorter the time "t" or the larger the voltage value V, the current value I increases. When the current value I is large, destruction of the DC-DC converter is caused.

FIG. 9 is a characteristic diagram illustrating changes in current Ix when the drive voltage Vx of the recording head rises from the voltage VL in the hibernation period to the voltage VH in the operation period. As illustrated in FIG. 9, at the same time when the drive voltage Vx rises from the voltage VL to the voltage VH, very large inrush current IpeakX is generated as the current Ix.

Objects of the present invention are to provide a recording device and a recording head voltage setting method capable of preventing a phenomenon that a power supply circuit is destroyed by inrush current occurring at the time of voltage rise.

To achieve at least one of the above-described objects, according to an aspect of the present invention, a recording device in which one aspect of the present invention is reflected is applied to a recording device performing recording operation by supplying drive voltage to a recording head having a predetermined nozzle capacity.

As a configuration, the recording device includes: a head voltage control unit of setting target voltage of head voltage used to perform recording operation by driving a recording head; a DC voltage generating unit generating drive voltage while giving a feedback so that the head voltage becomes the target voltage set by the head voltage control unit; and a smoothing capacitor connected between an output unit of the DC voltage generating unit and the recording head and having capacity which is twice or more as large as nozzle capacity of all of nozzles driven at the same timing of the recording head.

The output voltage of the DC voltage generating unit is increased to the target voltage over predetermined time.

To realize at least one of the above-described objects, a recording head voltage setting method in which one aspect of the present invention is reflected is applied to a recording head voltage setting method at the time of performing recording operation by supplying drive voltage to a recording head having predetermined nozzle capacity to which a smoothing capacitor is connected.

A recording head voltage setting method of the present invention includes: a head voltage control process of setting target voltage of head voltage used for performing recording operation by driving a recording head; and a DC voltage generating process of generating the drive voltage while applying a feedback so that the head voltage becomes the target voltage set by the head voltage control process and increasing output voltage to the target voltage over predetermined time.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, embodiments of the present invention will be described with reference to the drawings. However, the scope of the invention is not limited to the disclosed embodiments.

1. First Embodiment

Hereinafter, a first embodiment of the present invention will be described with reference to FIGS. 1 to 6. The first embodiment relates to an example of applying the present invention to a recording device having an ink jet recording head as a recording head. "Recording" in the specification refers to formation of a character, a figure, an image or the like on a recording medium such as a paper sheet by discharge of ink from a recording head.

1-1. Circuit Configuration

Figure 1:
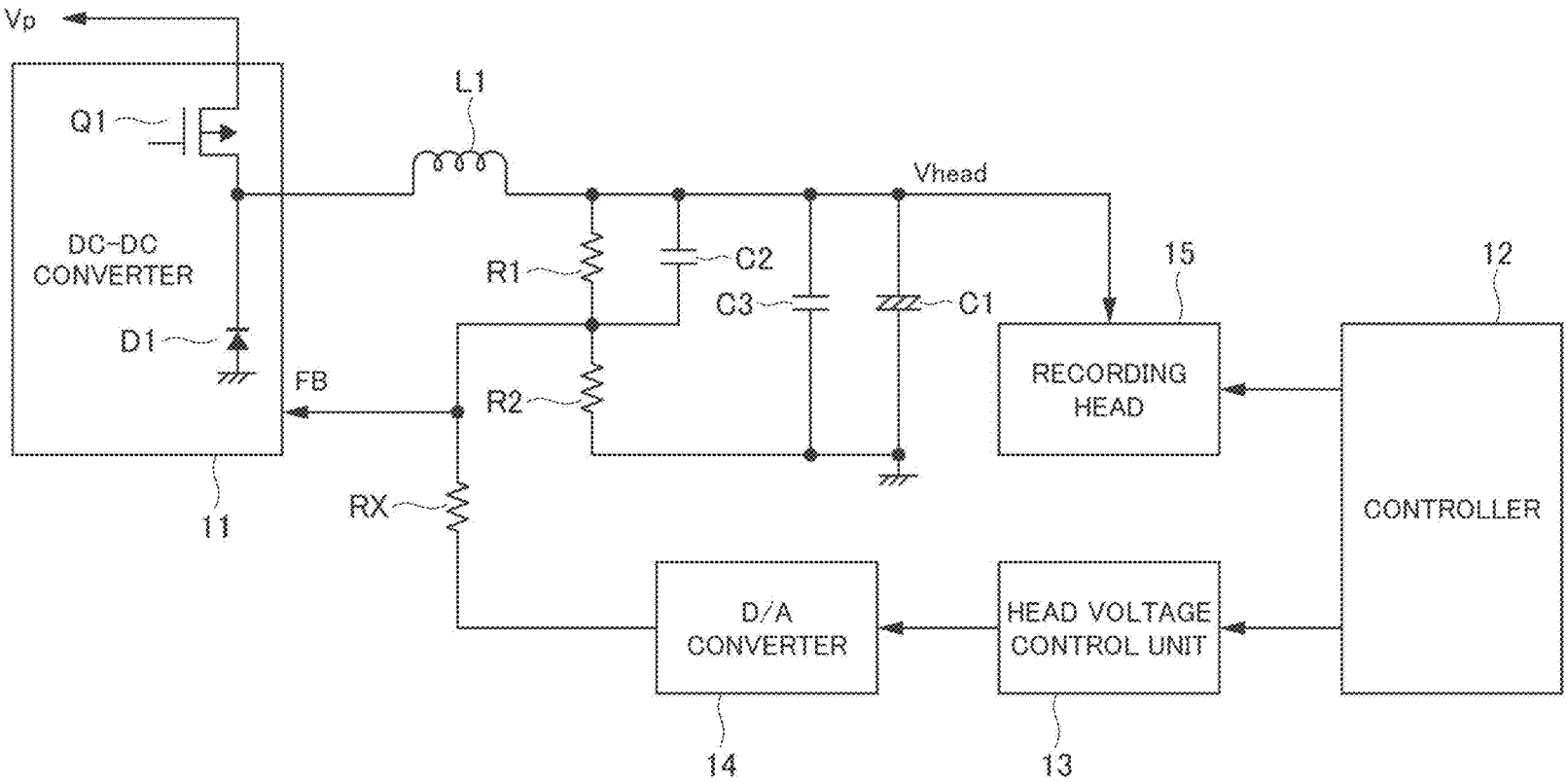
FIG. 1 is a circuit diagram illustrating a configuration example according to a first embodiment of the present invention.

FIG. 1 illustrates a circuit configuration of supplying drive voltage to a recording head 15.

The recording head 15 is an ink jet recording head in which a plurality of nozzles are disposed.

A drive voltage Vhead supplied to the recording head 15 is generated by a DC-DC converter 11. That is, the DC-DC converter 11 functions as a DC voltage generating unit obtaining desired output voltage by switching input voltage Vp by a switching element Q1 at high speed. A diode D1 is connected to the switching element Q1. The DC-DC converter 11 is controlled so that its output voltage becomes target voltage supplied from a D/A converter 14 which will be described later.

Output voltage of the DC-DC converter 11 is supplied to the recording head 15 via a coil L1. Between the coil L1 and the recording head 15, one end of a smoothing capacitor C1 as an electrolytic capacitor is connected. The other end of the smoothing capacitor C1 is grounded, and a capacitor C3 is connected in parallel to the smoothing capacitor C1. Further, an intermediate point between the coil L1 and the recording head 15 is grounded via a series circuit of resistors R1 and R2. A capacitor C2 is connected in parallel to the resistor R1.

The capacitor C2 is a capacitor for phase compensation, and the capacitor C3 is a ceramic capacitor of a high-speed type for compensating the response speed of the smoothing capacitor C1.

A connection point of the resistors R1 and R2 is connected to a feedback terminal (FB terminal) of the DC-DC converter 11. To the FB terminal of the DC-DC converter 11, voltage obtained at the output terminal of the D/A converter 14 which will be described later is supplied via a resistor RX.

Therefore, by the voltage of the sum of the voltage obtained by dividing the output voltage of the DC-DC converter 11 by the resistors R1 and R2 and the output voltage of the D/A converter 14, a feedback is applied to the FB terminal of the DC-DC converter 11.

In the DC-DC converter 11, the feed-back voltage is compared with reference voltage, the comparison result is sent to the gate of the switching element Q1, the duty ratio when the switching element Q1 is switched is changed, and the output voltage is controlled. The output voltage of the DC-DC converter 11 is voltage which is switched by the switching element Q1 and fluctuates at high speed but is smoothed by the coil L1 and the smoothing capacitor C1, and the stabilized drive voltage Vhead is supplied to the recording head 15.

As described in "Problems to be solved by the Invention", the smoothing capacitor C1 absorbs large fluctuation in the load current of the DC-DC converter 11 depending on the number of nozzles which discharge ink at the same time in the nozzles in the recording head 15, so that it has relatively large capacity. In the embodiment, the smoothing capacitor C1 has capacity twice or more (preferably, three times or more) as large as the capacity of the all of the nozzles in the recording head 15 which are driven at the same timing.

In the recording head 15, in a state where proper drive voltage Vhead is supplied, the discharge state of ink from each of nozzles is controlled by head control data supplied from a controller 12. The controller 12 sets the recording head 15 into a standby state by turn-on of the power to the recording device and, at a timing recording actually starts, shifts from the standby state into an operation state. It makes the drive voltage Vhead supplied from the DC-DC converter 11 to the recording head 15. In the case of the standby state, the voltage supplied to the recording head 15 is lower than the proper drive voltage Vhead.

Figure 3:
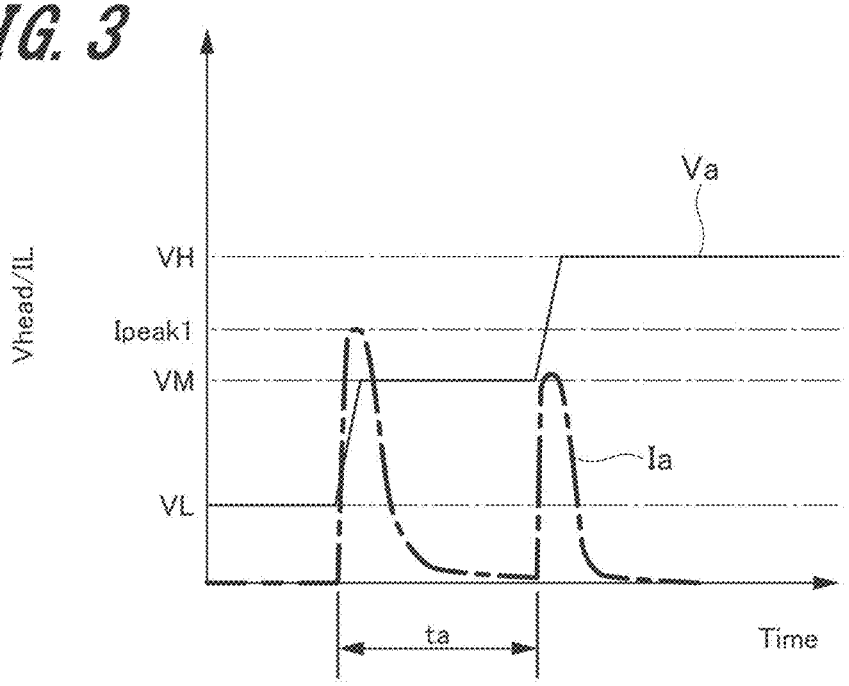
FIG. 3 is a characteristic diagram illustrating an example (example 1) of head drive voltage and inrush current according to the first embodiment of the present invention.

That is, in the standby state, the drive voltage supplied from the DC-DC converter 11 to the recording head 15 is low voltage for the standby state (voltage VL illustrated in FIG. 3). When the standby state changes to an operation state, a process of increasing the voltage to a voltage in the operation state (voltage VH illustrated in FIG. 3) is performed in response to an instruction from the controller 12. The voltage VL for the standby state is, for example, about 5V and the voltage VH for the operation state is, for example, about 15V.

As described above, to control the drive voltage, the controller 12 instructs a head voltage control unit 13 to increase the drive voltage at the time of a change from the standby state to the operation state. The head voltage control unit 13 which receives the instruction to increase the drive voltage performs a control process of generating a corresponding head voltage. Concretely, the head voltage control unit 13 generates voltage data which is supplied to the D/A converter (Digital/Analog converter) 14. The voltage data generated by the head voltage control unit 13 is converted to analog voltage by the D/A converter 14, and the analog voltage obtained by the D/A converter 14 is supplied to the FB terminal of the DC-DC converter 11 via the resistor RX.

In the embodiment, when the standby state changes to the operation state, the head voltage control unit 13 performs a control of changing the low voltage VL for the standby state to the voltage VH in the operation state step by step by taking predetermined time.

1-2 Drive Voltage Setting Process

Figure 2:
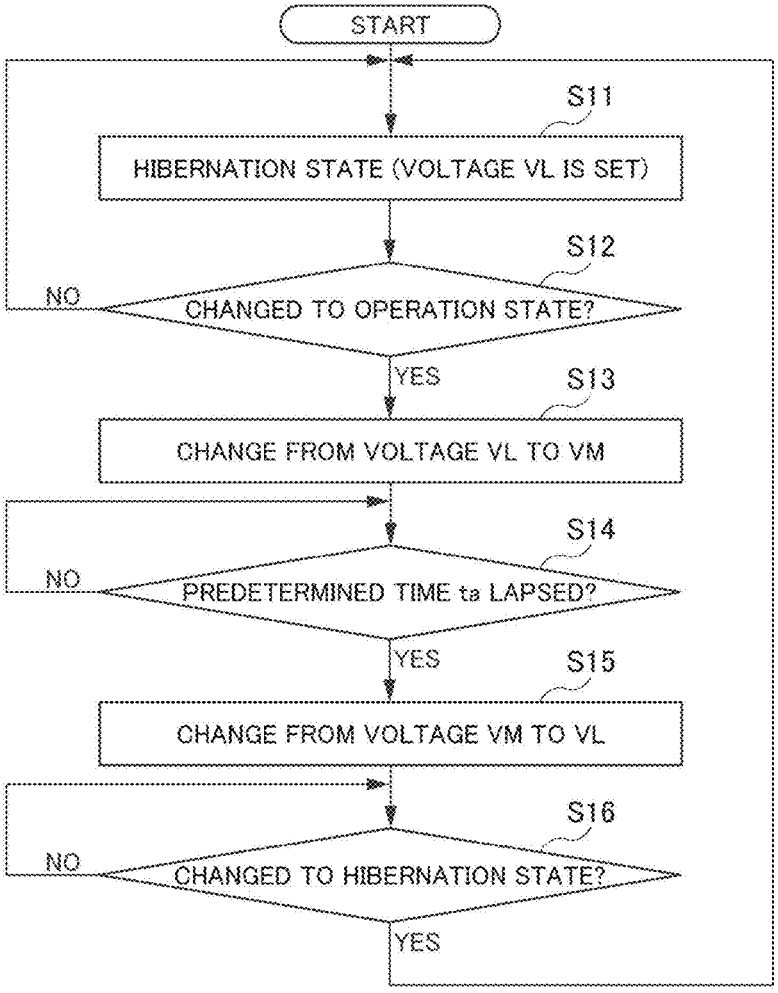
FIG. 2 is a flowchart illustrating a control example according to the first embodiment of the present invention.

FIG. 2 is a flowchart illustrating a processing operation in which the head voltage control unit 13 sets drive voltage on the basis of an instruction from the controller 12.

First, in the case of a hibernation state, the head voltage control unit 13 sets the low voltage VL for the hibernation state (step S11). The head voltage control unit 13 determines whether the hibernation state changes to the operation state by the instruction from the controller 12 or not (step S12). When it is determined that there is no change to the operation sate (NO in step S12), the head voltage control unit 13 maintains the setting of the low voltage VL for the hibernation state in step S11.

When it is determined in step S12 that there is a change to the operation state (YES in step S12), the head voltage control unit 13 changes voltage data which is output to the D/A converter 14 from data instructing the voltage VL to data instructing intermediate voltage VM (step S13). After that, the head voltage control unit 13 determines whether predetermined time ta has lapsed since the voltage VL is changed to the intermediate voltage VM (step S14). The predetermined time ta is, for example, time of a few microseconds to tens of microseconds.

When the predetermined time ta has not lapsed (NO in step S14), the head voltage control unit 13 waits until the predetermined time ta lapses. When it is determined in step S14 that the predetermined time ta has lapsed (YES in step S14), the head voltage control unit 13 changes the voltage data which is output to the D/A converter 14 from the data instructing the intermediate voltage VM to the data instructing the voltage VH for the operation state (step S15).

After the voltage VH at the time of the operation is set, the head voltage control unit 13 determines whether there is an instruction to change the state to the hibernation state due to the end of the recording or not (step S16). When it is determined that there is no instruction to change the state to the hibernation state (NO in step S16), the head voltage control unit 13 waits in the present voltage setting.

When it is determined in step S16 that there is an instruction to change the state to the hibernation state (YES in step S16), the head voltage control unit 13 returns to the process in step S11 and sets the voltage to the low voltage VL for the hibernation state.

1-3. Example of Concrete Voltages and Inrush Currents

FIG. 3 is a characteristic diagram illustrating the drive voltages and currents of the recording head 15 at the time of a change from the hibernation state to the operation state in the case of performing the control illustrated in the flowchart of FIG. 2.

Figure 9:
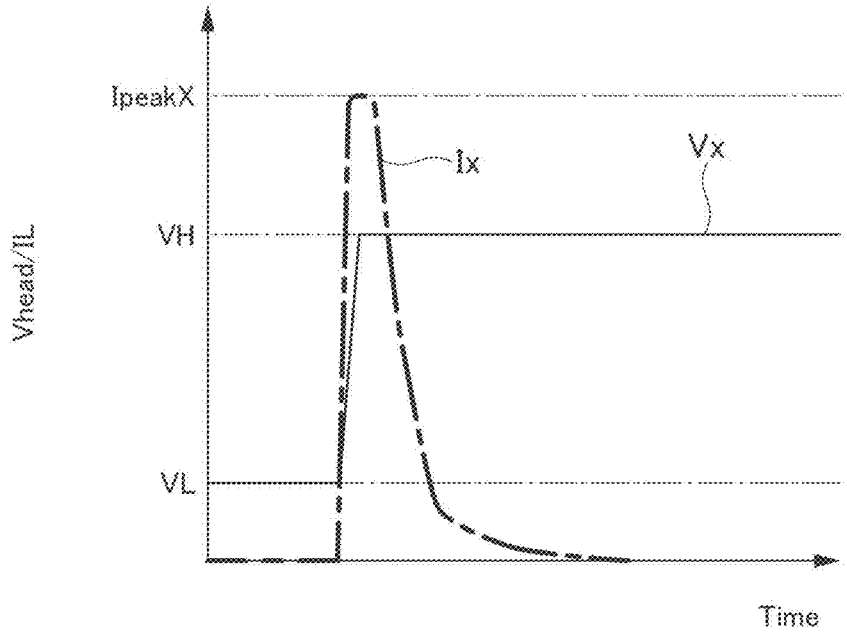
FIG. 9 is a characteristic diagram illustrating an example of conventional head drive voltage and inrush current.

In the example, the drive voltage Va changes from the voltage VL in the hibernation state to the intermediate voltage VM and, after lapse of the predetermined time ta since the change, changes from the intermediate voltage VM to the voltage VM at the time of the operation. Current Ia is current of the recording head 15. By increasing the voltage value in two stages in such a manner, the inrush current Ipeak1 can be made much smaller as compared with conventional one. Specifically, the inrush current can be made largely smaller than the inrush current IpeakX in the case of directly changing the voltage VL in the hibernation state to the voltage VH in the operation state in the conventional technique illustrated in FIG. 9. Therefore, an element provided for the DC-DC converter 11 or the like can be prevented from being destroyed by the inrush current. The reason why the inrush current increases is because the smoothing capacitor C1 is connected between the DC-DC converter 11 and the recording head 15.

Although the voltage value is increased in two stages in the example illustrated in FIG. 3, the voltage value may be increased in the larger number of stages.

Figure 4:
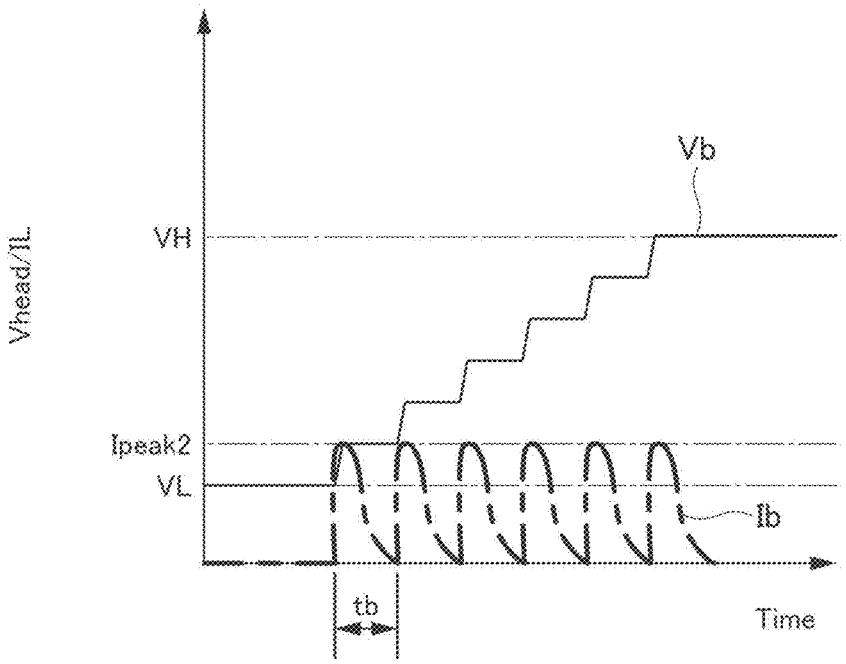
FIG. 4 is a characteristic diagram illustrating an example (example 2) of the head drive voltage and the inrush current according to the first embodiment of the present invention.

For example, in an example illustrated in FIG. 4, the drive voltage Vb is increased from the voltage VL to the voltage VH in six stages at the time of the change from the hibernation state to the operation state. In a manner similar to FIG. 3, the current Ib is the current of the recording head 15.

In the case of FIG. 4, predetermined time tb since the voltage changes until the voltage changes next is shorter than that in the example of FIG. 3.

In the case of the example illustrated in FIG. 4, inrush current Ipeak2 can be made a smaller value, so that destruction of an element by the inrush current can be prevented more effectively.

Figure 5:
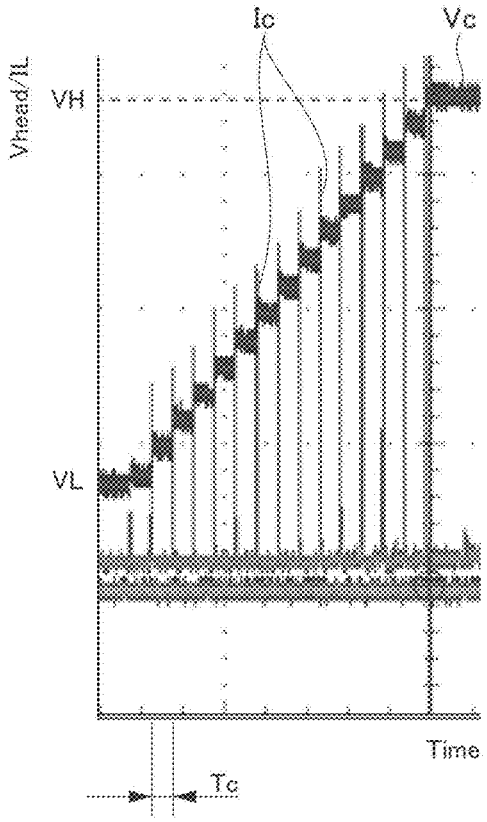
FIG. 5 is a characteristic diagram illustrating an example (example 3) of the head drive voltage and the inrush current according to the first embodiment of the present invention.

An example illustrated in FIG. 5 relates to the case where the voltage value is increased from the voltage VL to the voltage VH in 15 stages. FIG. 5 is different from FIGS. 3 and 4 with respect to the range of scales of voltage and current. Since FIG. 5 illustrates actually measured observation waveforms, subtle fluctuations are included in the voltage and current.

In the case of FIG. 5, the drive voltage Vc increases little by little every short predetermined time tc, and the fluctuation in the current Ic which occurs at the time of voltage increase can be further reduced.

Figure 6:
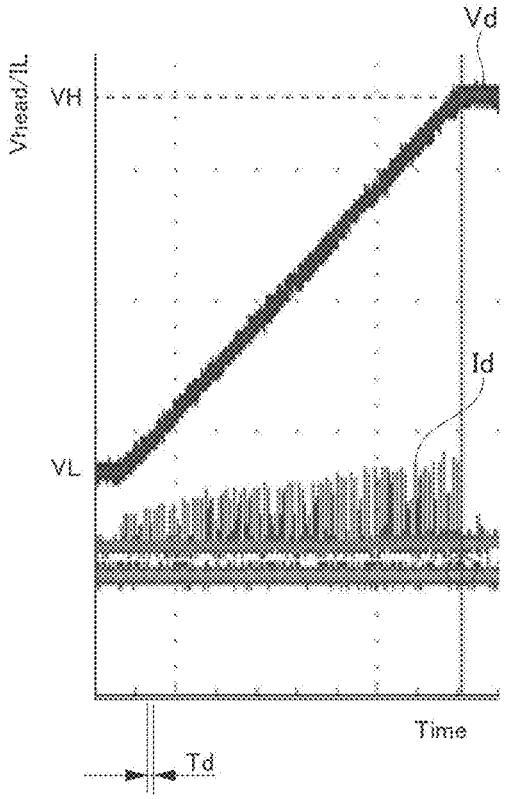
FIG. 6 is a characteristic diagram illustrating an example (example 4) of the head drive voltage and the inrush current according to the first embodiment of the present invention.

The example illustrated in FIG. 6 relates to the case of increasing the voltage value from the voltage VL to the voltage VH in tens of stages larger than the number of stages in the example of FIG. 5.

In the case of FIG. 6, the drive voltage Vd increases little by little every very short predetermined time td, and the fluctuation in the current Id which occurs at the time of voltage rise can be further reduced.

2. Second Embodiment

Figure 7:
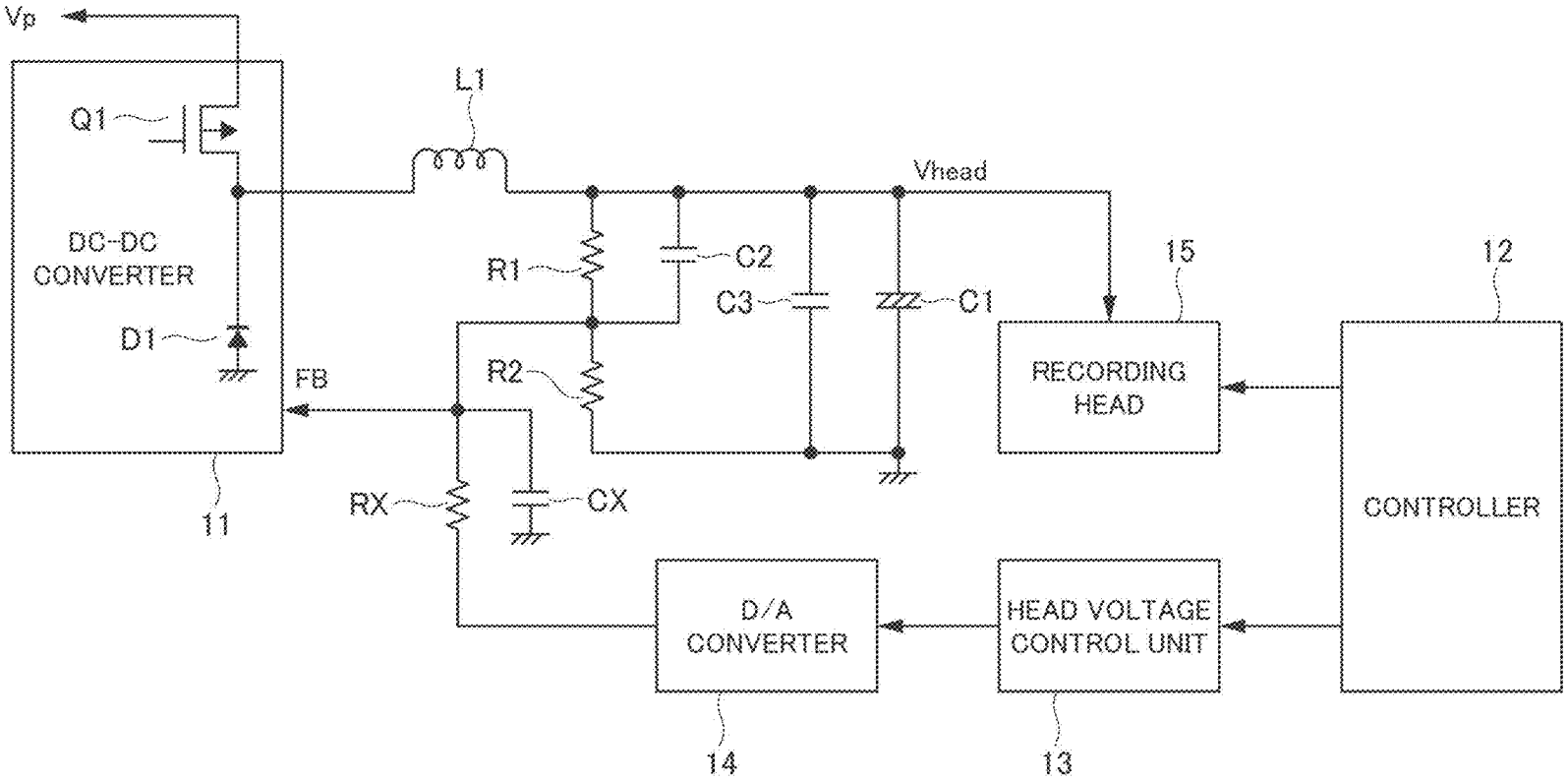
FIG. 7 is a circuit diagram illustrating a configuration example according to a second embodiment of the present invention.
Figure 8:
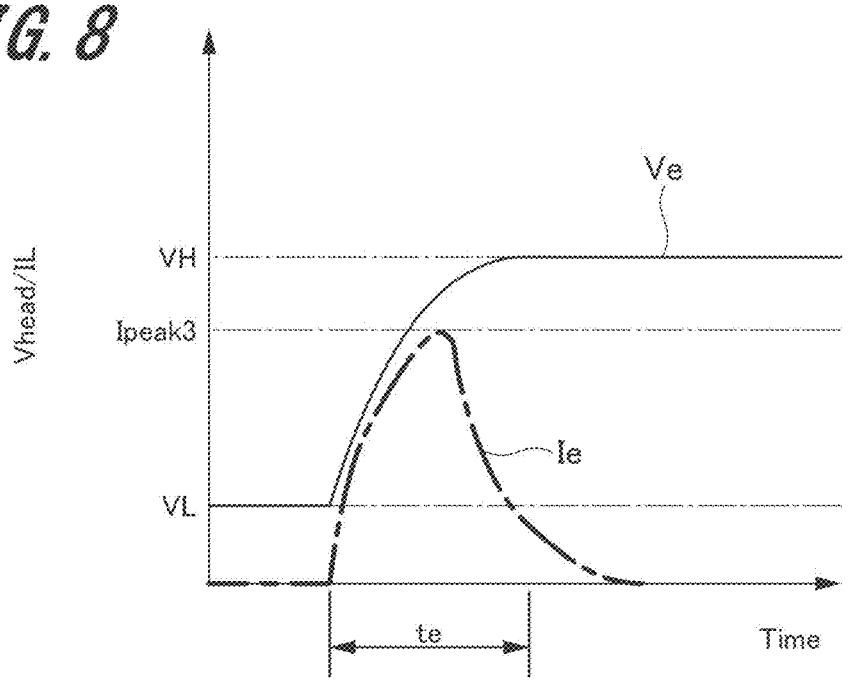
FIG. 8 is a characteristic diagram illustrating an example of the head drive voltage and the inrush current according to the second embodiment of the present invention.

Hereinafter, a second embodiment of the present invention will be described with reference to FIGS. 7 and 8. In FIGS. 7 and 8 for explaining the second embodiment, the same reference numerals are designated to parts corresponding to those in FIGS. 1 to 6 described in the first embodiment, and repetitive description will be omitted.

2-1. Circuit Configuration

FIG. 7 illustrates a circuit configuration of supplying the drive voltage to the recording head 15.

The basic configuration of the circuit illustrated in FIG. 7 is similar to that of the circuit illustrated in FIG. 1 except for the following. The head voltage control unit 13 does not perform the control of increasing the voltage value step by step at the time of changing the head voltage from the hibernation state to the operation state, as described with reference to the flowchart of FIG. 2 and the like.

In the circuit illustrated in FIG. 7, one end of the capacitor CX for correction as a capacitive element is connected to the FB terminal of the DC-DC converter 11, and the other end of the capacitor CX for correction is grounded.

By connecting the capacitor CX for correction, the voltage output from the D/A converter 14 is supplied to the FB terminal of the DC-DC converter 11 with a delay of a time constant determined by the resistor RX and the capacitor CX for correction.

The other part of the circuit illustrated in FIG. 7 is configured in a manner similar to the circuit illustrated in FIG. 1.

2-2. Example of Voltage and Inrush Current

FIG. 8 illustrates the drive voltage Ve and the current Ie of the recording head 15 at the time of a change from the hibernation state to the operation state in the second embodiment.

In the case of the circuit illustrated in FIG. 7, the capacitor CX for correction is connected to the FB terminal of the DC-DC converter 11, so that the voltage from the D/A converter 14 is supplied with the time constant to the DC-DC converter 11. Therefore, the drive voltage Ve output from the DC-DC converter 11 gradually increases from the voltage VL to the voltage VH in a predetermined time te. The predetermined time te in this case is relatively long time of, for example, about tens of microseconds to hundreds of microseconds.

Therefore, the inrush current Ipeak3 generated at the time of the change from the voltage VL to the voltage VH does not also come to have an outstanding peak, so that generation of high inrush current can be prevented.

Consequently, even in the case where the smoothing capacitor C1 of large capacity is coupled between the DC-DC converter 11 and the recording head 15 like in the first embodiment, an element of the DC-DC converter 11 or the like is not destroyed by the inrush current.

3. Modifications

The configuration of performing the control of increasing the voltage step by step, described in the first embodiment may be combined with the configuration of connecting the capacitor CX for correction to provide the time constant, described in the second embodiment.

Although the DC-DC converter 11 in which the switching element performs the switching operation is provided as a DC voltage generating unit of generating drive voltage in each of the embodiments, another DC voltage generating unit may be applied. For example, as the DC voltage generating unit, a variable voltage 3-terminal regulator may be used.

The voltages and the times described in the embodiments are examples, and the present invention is not limited to the above-described values in carrying out of the invention. The scope of the present invention should be interpreted by terms of the appended claims

11 DC-DC converter
12 controller
13 head voltage control unit
14 D/A converter
15 recording head
C1 smoothing capacitor
CX capacitor for correction

What is claimed is:

1. A recording device performing recording operation by supplying drive voltage to a recording head having predetermined nozzle capacity, comprising:

a head voltage control unit of setting target voltage of head voltage used to perform the recording operation by driving the recording head;

a DC voltage generating unit generating drive voltage which increases over a plurality of stages, while giving a feedback at each stage, until the head voltage becomes the target voltage which is set by the head voltage control unit; and a smoothing capacitor connected between an output unit of the DC voltage generating unit and the recording head and having capacity which is twice or more as large as capacity of all of nozzles of the recording head driven at the same timing, wherein, when increasing output voltage of the DC voltage generating unit, the output voltage is increased over a predetermined time at each of the plurality of stages until the target voltage is reached, and wherein an inrush current peak at each of the plurality of stages is less than an inrush current peak when the output voltage is directly increased to the target voltage.

2. The recording device according to claim 1, wherein the DC voltage generating unit is a DC-DC converter, and an inductor is provided between an output unit of the DC-DC converter and the capacitor.

3. The recording device according to claim 1, wherein the head voltage control unit is constructed by a control unit outputting voltage control data and a digital/analog converter converting the voltage control data output by the control unit to a voltage value.

4. The recording device according to claim 1, wherein the head voltage control unit increases output voltage of the DC voltage generating unit step by step every division time obtained by dividing the predetermined time.

5. The recording device according to claim 1, wherein at the time of applying a feedback so that the output voltage becomes the target voltage set by the head voltage control unit, by connecting a capacitive element to a feedback resistor and delaying the voltage increase by the capacitive element, the voltage is increased to the target voltage over the predetermined time.

6. A recording head voltage setting method of performing recording operation by supplying drive voltage to a recording head to which a smoothing capacitor is connected and has predetermined nozzle capacity, comprising:

a head voltage control process of setting target voltage of head voltage used for performing recording operation by driving the recording head; and a DC voltage generating process of generating the drive voltage, which increases over a plurality of stages, while applying a feedback at each stage, until the head voltage becomes the target voltage set by the head voltage control process and increasing output voltage to the target voltage over predetermined time, wherein, when increasing output voltage of the DC voltage generating unit, the output voltage increases over a predetermined time at each of the plurality of stages until the target voltage is reached, and wherein an inrush current peak at each of the plurality of stages is less than an inrush current peak when the output voltage is directly increased to the target voltage.

* * * * *